United States Patent [19]

Ogihara et al.

[11] 4,247,931

[45] Jan. 27, 1981

[54] SLIP MECHANISM FOR A TIMEPIECE

[75] Inventors: Masuo Ogihara; Kozo Chimura; Nobuo Shinozaki, all of Shikawatashi, Japan

[73] Assignee: Seiko Koki Kabushiki Kaisha, Tokyo, Japan

[21] Appl. No.: 911,320

[22] Filed: Jun. 1, 1978

[30] Foreign Application Priority Data

Jun. 14, 1977 [JP] Japan ..... 52-77335

[51] Int. Cl.[3] ..... G04B 21/00; G04B 13/00

[52] U.S. Cl. ..... 368/185; 368/62; 368/76

[58] Field of Search ..... 58/7, 23 R, 23 D, 59, 58/63-65, 85.5, 139; 192/70.23, 7.27, 83 A

[56] References Cited

U.S. PATENT DOCUMENTS

| | | | |
|---|---|---|---|
| 2,990,676 | 7/1961 | Jensen | 58/59 X |
| 3,365,723 | 1/1968 | Spormann | 58/85.5 |
| 3,785,141 | 1/1974 | Ikegami | 58/85.5 |
| 4,127,984 | 12/1978 | Ogihara et al. | 58/7 |

*Primary Examiner*—Edith S. Jackmon

*Attorney, Agent, or Firm*—Robert E. Burns; Emmanuel J. Lobato; Bruce L. Adams

[57] ABSTRACT

A slip mechanism for a timepiece comprises a rotational shaft having a pinion, a gear and a spring wherein the rotational shaft has a flange for supporting the gear, a mounting portion formed adjacent the surface of the flange for rotatably mounting the gear and slots formed above the mounting portion for engagement with the spring. The slots coact with recessed portions of the spring for preventing the spring from rotating with respect to the shaft.

6 Claims, 5 Drawing Figures

FIG. 3
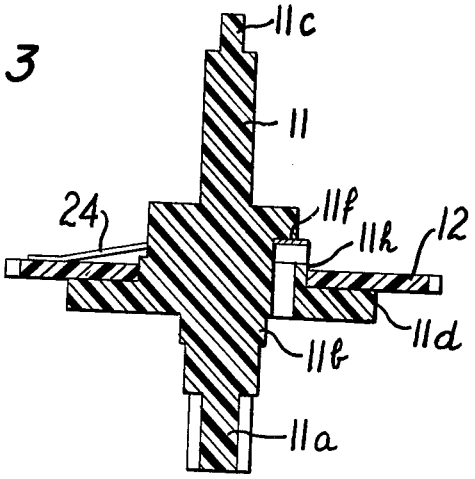
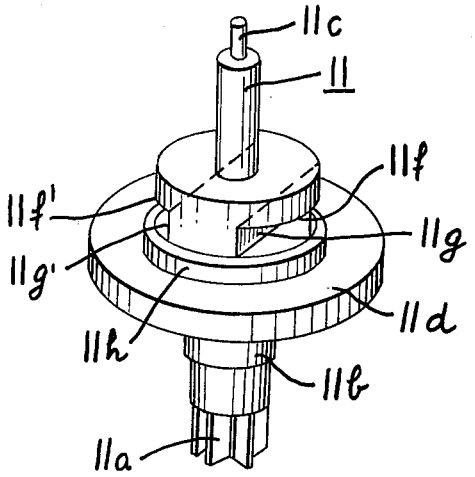
FIG. 4
FIG. 5
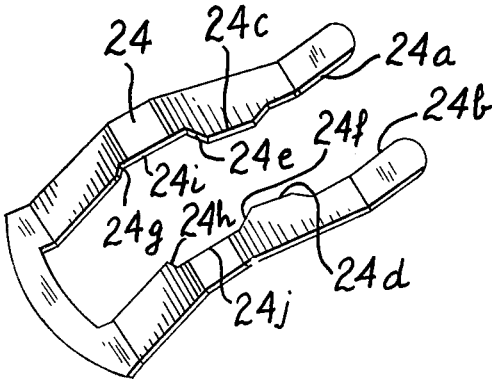

SLIP MECHANISM FOR A TIMEPIECE

BACKGROUND OF THE INVENTION

This invention relates to a gear train structure for a timepiece and, in particular, to improvements in a slip mechanism for use in the gear train.

In conventional slip mechanisms, it has heretofore been practiced generally, for example, to combine a pinion with a gear placed on it and a spring mounted further thereon by way of calking thereby intensely urging the gear to the pinion by the spring to connect them frictionally.

Such method is, however, disadvantageous from an economical point of view since connecting steps such as calking are required and a great loss result for each faulty or defective assembly produced.

Another conventional method has been known in which a gear is fabricated from metal and integrally formed together with a pinion upon plastic molding of the latter.

This method is also defective in that the slip torque is greatly changed with even a slight variation in forming conditions because the slip torque is determined by the force resulted between the metal and the plastic upon forming of the assembly.

A further method of providing a flexible arm to either one of a gear and a pinion made of plastic to obtain a slip torque by frictionally connecting them with the flexible arm is defective in that a reliability of the slip mechanism is very low since the slip torque tends to change with even slight changes in temperature and humidity.

It is, accordingly, an object of this invention to eliminate the foregoing drawbacks and provide a structure which is inexpensive and quickly and easily highly reliable and capable of connection with a gear train assembly.

The foregoing defects can be overcome by a slip mechanism comprised of a gear, pinion and a spring, in which the pinion is formed with a guide portion for rotationally guiding the gear, a supporting portion for bearing the height of the spring and an anti-rotation portion for the spring, and designed such that the pinion and the spring are rotated together upon slipping.

BRIEF DESCRIPTION OF THE DRAWINGS

This invention will now be described by way of a preferred embodiment thereof referring to the accompanying drawings, wherein

FIG. 3 is a sectional view taken along a line A—O—A in FIG. 2 and

FIG. 4 and FIG. 5 are perspective views of the slip mechanism parts shown in FIG. 1.

DESCRIPTION OF PREFERRED EMBODIMENT

Figure 1:
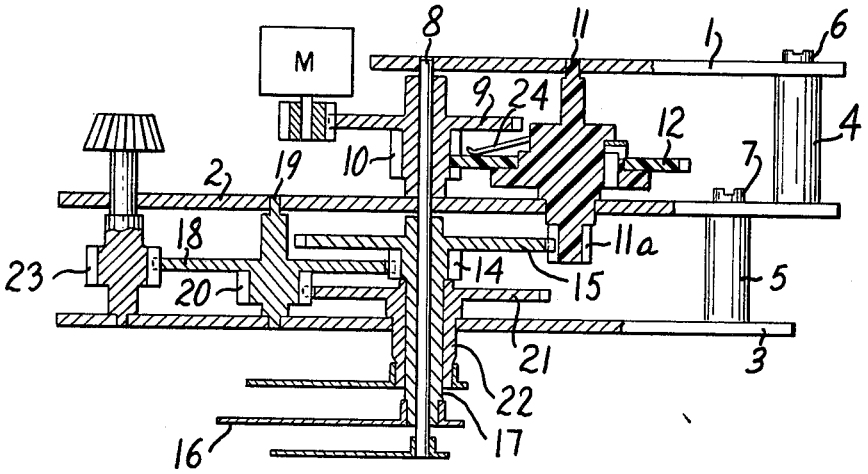
FIG. 1 is a sectional view of a gear train showing a preferred embodiment of this invention.

Referring to FIG. 1, an upper plate 1, an intermediate plate 2 and a lower plate 3 for rotationally supporting a gear train are secured to each other way of posts 4 and 5 and screws 6 and 7 which extend through the posts and are screwed into respective one of the plates.

A second shaft 8 is rotationally supported by the above upper and the lower plates 1 and 2 and is securely connected to a second wheel 9 driven by a motor M and a first pinion 10. A shaft 11 is also rotationally supported by the upper and the lower plates 1 and 2 and fixedly provided with a second pinion 11a for engagement with a minute wheel 15. The shaft 11 frictionally and rotatably holds a first intermediate gear wheel 12 that meshes with the second wheel 9. The minute wheel 15 is fixed with a third pinion 14 and a pipe 17 having a minute indicator attached at its top. A second intermediate gear wheel 18 for engagement with the third pinion 14 is fixed together with a fourth pinion 20 to a shaft 19 which is rotatably supported by the intermediate and the lower plates 2 and 3. An hour wheel 21 meshes with the fourth pinion 20 and is secured to an hour indicator pipe 22 rotationally supported by the lower plate 3. The second intermediate gear wheel 18 meshes with a time amend wheel 23. In the gear train of the above constitution, if the slip torque is set lower than the static coupling force of the motor, since the first intermediate wheel 12 slips against the shaft 11 upon rotation of the time amend wheel 23 when a watch user wants to amend the present time, only the portion of the gear train behind the minute wheel 15 is rotated.

Figure 2:
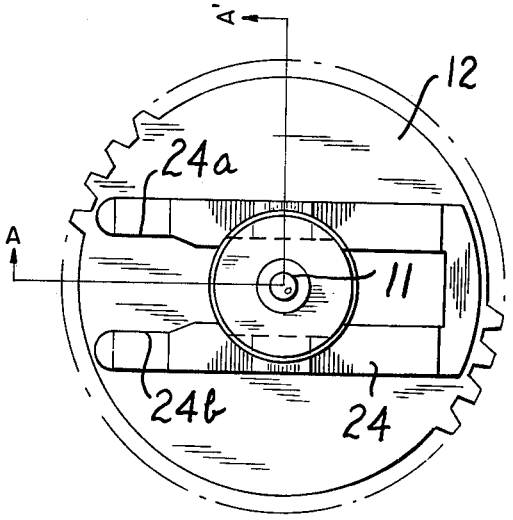
FIG. 2 is a plan view of the slip mechanism.

Reference will now be made in detail to the frictional coupling mechanism between the first intermediate gear wheel 12 and the shaft 11 shown in FIG. 2 and in the succeeding figures. As described above, the shaft 11 is formed at its lower portion with a second pinion 11*a* and a rotational sliding portion 11*b* which is rotationally supported by the aperture in the intermediate plate 2, as well as at its top with a second rotational sliding portion 11*c* which is rotationally supported by the upper plate 1. Further, in the middle of the shaft 11, are formed a flange portion 11*d* for rotatably supporting thereon the first intermediate gear wheel 12 and a mounting portion 11*h* formed above the flange portion 11*d* for mounting the intermediate gear wheel 12. Also formed are spring bearing portions 11*f* and 11*f'* for defining the height of the spring 24 and interengaging portions 11*g* and 11*g'* comprising slats in the shaft 11 for the planar positioning of the spring and coacting with complementary interengaging portions of the spring 24 to prevent relative rotation 24.

Referring now to the constitution of the spring 24, it has a generally U-shaped, bent configuration having interengaging portions 24*a* and 24*b* for engagement with the complementory interengaging portions 11*g* and 11*g'* of the shaft 11, flexible portions 24*c* and 24*d*, guide portions 24*i* and 24*j* and, with anti-slip off portions 24*e* . . . 24*h* for preventing the spring 24 per se from slipping off. The U-shaped spring 24 has two spring arms connected at one end by a base portion and when viewed in side elevation, the spring arms have a generally V-shape with recessed portions 24*i* and 24*j* being formed at the vertex of the V for engaging the inner walls of the slots 11*g* and 11*g'*.

A description will now be given of the manner of coupling of the shaft 11, the first intermediate wheel 12 and the spring 24. The first intermediate gear wheel 24 12 is first inserted to the shaft 11 from above while guided along the rotational guiding portion 11*h* of the shaft 11 and then the spring 24 is inserted to the shaft 11 laterally along the anti-spring rotation portions 11*g* and 11*g'* whereby the rotating direction of the spring 24 is restricted by the embracing portions 24*a* and 24*b* of the spring 24. Upon further insertion of the spring 24, the spring arms expand their outwardly by resiliency and the vertical movement of the spring 24 is regulated by the upper face of the first intermediate gear wheel 12 and the spring bearing portions 11*f* and 11*f* of the shaft 11, whereby the spring 24 is vertically flexed and its flexible portions 24*c* and 24*d* advance along the anti-spring rotation portions 11*g* and 11*g'*. When the flexible portions 24*c* and 24*d* pass over its anti-spring rotation portions 11*g* and 11*g'*, the spring resumes the initial state by its own returning force. In the assembly state, the spring 24 is retained by the anti-slip off portions 24*e*. . 24*h* of the shaft 11 and can not be readily disengaged. In the above coupled state, since the spring 24 is resiliently held between the upper face of the first intermediate wheel 12 and the spring bearing portions 11*f* and 11*f* and the shaft 11 is urged upwardly with respect to the first intermediate gear wheel 12, a constant torque is produced between them. The first intermediate gear wheel 12 and the shaft 11 can thus be coupled by simple manual operation.

While the slip mechanism is provided in the first intermediate wheel in the above embodiment, similar effects can be obtained as well by providing it between the minute wheel and its pinion. In addition, the intermediate wheel and the shaft can be made either with metal or plastic to attain the similar effects.

According to this invention, a slip mechanism of an excellent economical advantage and a high relliability can be obtained and, hence, this invention has much practical importance.

We claim:

1. A slip mechanism for a timepiece having a gear train comprising: a rotatable shaft having axially disposed therealong and fixedly connected thereto a pinion, a flange for rotatable supporting thereon a gear wheel of the gear train during use of the slip mechanism, a mounting portion adjacent said flange for rotatably mounting the gear wheel, and two diametrically spaced apart slots each of which has an inner wall; and spring means resiliently urging the gear wheel into frictional contact with said flange to form therebetween a frictional drive connection which can be overridden to permit rotational slipping of the gear wheel and flange relative to one another, said spring means comprising a generally U-shaped spring having two spring arms connected at one end by a base portion, the two spring arms engaging the inner walls of said two diametrically spaced apart slots to prevent relative rotation between said shaft and spring means.

2. A slip mechanism according to claim 1; wherein said spring means and shaft have complementary interengaging portions to connect together said spring means and shaft for common rotational movement.

3. A slip mechanism according to claim 1 wherein each spring arm has a recessed portion which engages said shaft.

4. A slip mechanism according to claim 3; wherein each spring arm is generally V-shaped in side elevation, the said recessed portion of each spring arm being formed at the vertex of the spring arm such that the vertex of each arm engages the slot inner wall while the free end of each spring arm engages the surface of the gear wheel.

5. A slip mechanism according to claim 1 or 2; wherein said shaft is composed of plastic material.

6. A slip mechanism according to claim 5; including in combination therewith a timepiece; and wherein the slip mechanism is positioned between a seconds gear wheel having a second hand and a minute gear wheel having a minute hand of the timepiece, the gear wheel carried by said shaft being driveably connected to the seconds gear wheel, and said pinion on said shaft being driveably connected to the minute gear wheel.

* * * * *